United States Patent [19]

Ham et al.

[11] 4,036,045

[45] July 19, 1977

[54] CALIBRATED ADJUSTABLE ROLL STRAIGHTENER FOR WIRE

[75] Inventors: Emmett P. Ham; Albert S. Johnson, Jr., both of Goldsboro, N.C.

[73] Assignee: General Electric Company, Schenectady, N.Y.

[21] Appl. No.: 705,344

[22] Filed: July 14, 1976

[51] Int. Cl.[2] ..... B21D 3/02

[52] U.S. Cl. ..... 72/165

[58] Field of Search ..... 72/160, 164, 165, 163; 140/147

[56] References Cited

U.S. PATENT DOCUMENTS

| | | | |
|---|---|---|---|
| 3,245,244 | 4/1966 | Polakowski | 72/163 |
| 3,605,471 | 9/1971 | Bodtke | 72/165 |

FOREIGN PATENT DOCUMENTS

| | | | |
|---|---|---|---|
| 529,198 | 7/1931 | Germany | 72/165 |
| 746,765 | 3/1956 | United Kingdom | 72/160 |

*Primary Examiner*—Milton S. Mehr

*Attorney, Agent, or Firm*—Paul F. Wille; Lawrence R. Kempton; Frank L. Neuhauser

[57] ABSTRACT

A roll straightener for wire is disclosed in which rolls on each side of the wire are mounted in fixed spatial relation in supports and the relative positioning of the supports is adjusted, depending on wire type and size, to produce straightened wire.

6 Claims, 2 Drawing Figures

CALIBRATED ADJUSTABLE ROLL STRAIGHTENER FOR WIRE

BACKGROUND OF THE INVENTION

This invention relates to wire straighteners and, in particular, to wire straighteners comprising a series of rolls carried on a frame so as to engage opposite sides of a wire and flex and straighten the wire passing between the rolls.

Among the variety of wire straighteners available, one of two types is generally used. One is the rotary straightener having adjustable, offset dies which rotate about the wire at high speed, e.g., several thousand revolutions per minute. These machines tend to be both dangerous and extremely noisy and must be operated in a suitable enclosure for the safety of factory personnel. In addition, the quality or accuracy of the straightening depends upon the experience and skill of the person adjusting the dies. Also, the straightener must be motor driven, requiring belts and guards for the driving equipment, further increasing the cost of the straightener.

Roll straighteners do not require rotary motion or driving equipment. The wire is drawn through a series of rolls so that the wire follows a bent path, flexing in one direction and then in the opposite direction, usually undergoing a decreased amount of flexure as it proceeds through the straightener.

Several types of roll straighteners are available with differing methods for adjusting the rolls. With each, however, once a setting has been found for a specific size and type of wire, usually by trial and error, the settings cannot be repeated since there are no accurate reference points.

One approach to the problem, discussed in U.S. Pat. No. 3,343,574, has been to provide individual linear scales for each roll. As this patent recognizes, some means must be provided for exaggerating the readings to obtain reproducible results. The roll straightener described in this patent, as with others in the art, utilizes individually adjustable rolls. Setting each roll, even with improved scales, is tedious. Further, depending upon the number of rolls, the cumulative error with each setting may obviate reproducibility, thereby requiring skilled personnel to adjust the machine for each wire change.

SUMMARY OF THE INVENTION

In view of the foregoing, it is therefore an object of the present invention to provide an improved roll straightener capable of reproducible results even when reset by unskilled personnel.

Another object of the present invention is to provide an easily calibrated roll straightener.

A further object of the present invention is to provide an improved roll straightener that is mechanically simpler than those of the prior art.

Another object of the present invention is to provide an improved roll straightener that is more easily adjusted than those of the prior art.

A further object of the present invention is to provide an improved roll straightener that is more easily reset for different sizes or types of wire.

The foregoing objects are achieved in the present invention wherein it has been found that the rolls on the same side of the wire can be fixed relative to each other. The straightener thus comprises two supports, one for each set of rolls, connected at one end by a pin so that one support can pivot relative to the other. The spacing of the free ends of the supports is controlled by a single screw having a calibrated dial attached thereto. Thus, all of the rolls are adjusted simultaneously in a single adjustment to provide the necessary straightening of the wire. Means are also provided for adjusting roller offset.

BRIEF DESCRIPTION OF THE DRAWING

A more complete understanding of the present invention can be obtained by considering the following detailed description in conjunction with the accompanying drawing, in which.

DESCRIPTION OF THE PREFERRED EMBODIMENTS

Figure 2:
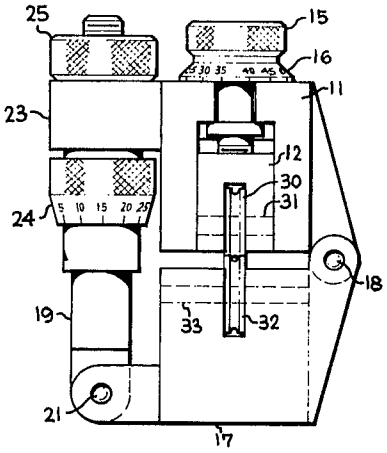
FIG. 2 illustrates an end view of a preferred embodiment of the present invention.
Figure 1:
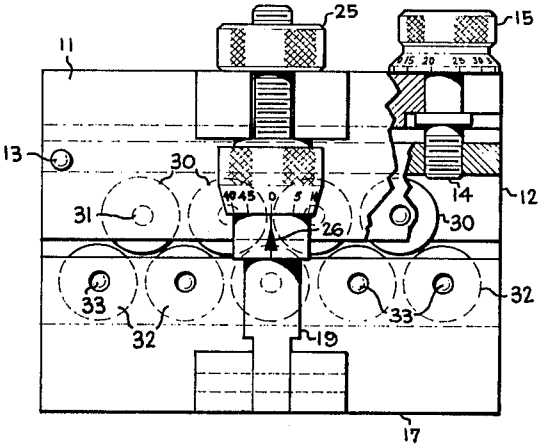
FIG. 1 illustrates a side view of a preferred embodiment of the present invention.

Referring to both FIGS. 1 and 2, wherein like elements bear the same reference number, the wire straightener in accordance with the present invention comprises frame 11 having a pivot member 12 closely fitting within a U-shaped portion of frame 11 as seen in FIG. 2. Pivot member 12 is connected to frame 11 by pin 13 and calibrated adjusting screw 14. The uppermost portion of screw 14 comprises knob 15 and calibrated dial 16. Lower portion 17 of frame 11 is connected thereto by pin 18, which is approximately parallel to the direction of travel of the wire, and by a swing-away clamp screw 19, which pivots about pin 21 and engages clamp bar 23. Positioned between pivot pin 21 and clamp bar 23 is a suitably threaded calibrated dial 24. Locknut 25 is threaded onto the end of clamp screw 19.

Pivot member 12 and lower portion 17 of frame 11 are the supports for two sets of rolls, one for each side of the wire, comprising a plurality of rolls 30 turning on fixed centers 31 and rolls 32 turning on fixed centers 33. While centers 31 and 33 are illustrated in FIG. 1 as falling on horizontal parallel lines, it is understood by those of skill in the art that a line through centers 31 and a line through centers 33 would be intersecting rather than parallel. Specifically, as illustrated in FIG. 1, the left-hand side of the roll straightener is the entrance side and the right-hand side of the roll straightener is the exit side. The lines through centers 31 and 33 would intersect to the left, i.e., on the entrance side, of the roll straightener. This is to provide a gradually decreasing flexure of the wire as it passes through the roll straightener.

While FIG. 2 illustrates the peripheral groove in rolls 30 and 32 as having a radiused cross section, a V-shaped cross section or other suitable shape may be used.

In an actual wire straightening operation, two consecutive wire straighteners are utilized; the first, for example, having the orientation illustrated in FIG. 2, and the second having the rolls positioned orthogonally to the first. Since these straighteners are identical, the following description of the operation of the straightener in accordance with the present invention is of one of the identical straightening operations.

Wire is inserted into the straightener by loosening locknut 25 and swinging away clamp screw 19. This enables the upper portion of frame 11 to swing away so that wire can be inserted between rolls 30 and 32. Clamp screw 19 is inserted into clamp bar 23 and adjusting dial 24 turned to provide the desired offset adjustment of rolls 30 and 32. The offset adjustment moves all of rolls 30 the same amount relative to rolls 32 and controls the amount of initial flexure given the wire. Locknut 25 is then tightened to secure this setting, indicated by reference mark 26. Screw 14 is then turned until the desired taper adjustment, as indicated by a suitable reference adjacent dial 16, is obtained. Screw 14 varies the taper or the point of intersection of the lines through centers 31 and 33. That is, right-hand-most roll 30 is moved more relative to right-hand-most roll 32.

For a new type or diameter wire, these settings must be determined empirically. Even this is more easily accomplished since there is but a single adjustment, screw 14, for varying the taper of the two sets of rolls. In addition, once obtained, the setting is readily reproduced without accumulation of errors, again by the single adjustment for each of offset and pitch.

There is thus provided by the present invention an easily calibrated roll straightener capable of reproducible results even when reset by unskilled personnel. Further, the straightener is mechanically simpler than those of the prior art while retaining the advantages of being safer and quieter than rotary-type straighteners.

Having thus described the invention, it will be apparent to those of skill in the art that various modifications may be made within the spirit and scope of the present invention. For example, any number of rolls greater than three may be used in accordance with the present invention. As known in the art, the more rolls there are, the less severely the wire must be flexed for each bend in the straightener. However, this must be reconciled with the cost of manufacture and subsequent maintenance incurred by excessively increasing the number of rolls. Similarly, it is preferred, but not required, that an odd number of rolls be utilized so that the one set contains one more roll than the other.

What we claim as new and desire to secure by Letters Patent of the United States is:

1. A wire straightener comprising:

a frame having two parts;

first pivot means joining said parts at one side thereof;

offset adjusting means interconnecting the sides of said parts opposite said first pivot means;

a first support means having a plurality of rolls in fixed spatial relation;

a second support means, comprising one of said parts, having a plurality of rolls in fixed spatial relation;

second pivot means for locating one end of each of said support means relative to the other; and pitch adjusting means coupled to the other ends of said support means for controlling the spacing of said other ends.

2. The wire straightener as set forth in claim 1 wherein said other part comprises:

a member having a U-shaped cross section with the open part of the U facing said one part, said first support means fitting within said other part and being joined thereto by said first pivot means.

3. The wire straightener as set forth in claim 2 wherein said first support means is connected to said other part by said pitch adjusting means.

4. The wire straightener as set forth in claim 3 wherein the axes of the rolls in said first support means are parallel and in the same plane and wherein the axes of the rolls in said second support means are parallel and in the same plane.

5. The wire straightener as set forth in claim 4 wherein said planes intersect on the entrance side of said straightener.

6. The wire straightener as set forth in claim 5 wherein each roll has a peripheral groove having a radiused cross section.

* * * * *